US005261663A

United States Patent [19]

Anderson

[11] Patent Number: 5,261,663

[45] Date of Patent: * Nov. 16, 1993

[54] GOLF CLUB HEAD AND METHOD OF FORMING SAME

[75] Inventor: Donald A. Anderson, 7861 Clay Ave., #4, Huntington Beach, Calif. 92649

[73] Assignees: Donald A. Anderson; Donald J. C. Sun

[ * ] Notice: The portion of the term of this patent subsequent to Jun. 18, 2008 has been disclaimed.

[21] Appl. No.: 806,348

[22] Filed: Dec. 13, 1991

Related U.S. Application Data

[63] Continuation-in-part of Ser. No. 549,973, Jul. 9, 1990, Pat. No. 5,094,383, which is a continuation-in-part of Ser. No. 492,973, Mar. 13, 1990, Pat. No. 5,024,437, which is a continuation-in-part of Ser. No. 364,698, Jun. 12, 1989, abandoned.

[51] Int. Cl.[5] ..... A63B 53/04

[52] U.S. Cl. ..... 273/78; 273/173; 273/167 H

[58] Field of Search ..... 273/167-175, 273/77 R, 77 A, 78, 79, 193 R, 194 R, 164

[56] References Cited

U.S. PATENT DOCUMENTS

| | | | |
|---|---|---|---|
| 1,257,471 | 2/1918 | Fitzjohn et al. . | |
| 1,359,220 | 11/1920 | Beamer . | |
| 1,463,533 | 7/1923 | Kurz . | |
| 1,589,363 | 6/1926 | Butchart . | |
| 1,665,523 | 4/1928 | Boyce . | |
| 2,034,936 | 3/1936 | Barnhart . | |
| 2,447,967 | 8/1948 | Stone . | |
| 3,218,072 | 11/1965 | Burr | 273/173 X |
| 3,387,844 | 6/1968 | Shippee . | |
| 3,970,236 | 7/1976 | Rogers . | |
| 4,027,885 | 6/1977 | Rogers | 273/173 X |
| 4,252,262 | 2/1981 | Igarashi | 273/173 X |
| 4,398,965 | 8/1983 | Campau | 273/78 X |
| 4,432,549 | 2/1984 | Zebelean | 273/167 H |
| 4,438,931 | 3/1984 | Motomiya . | |
| 4,465,221 | 8/1984 | Schmidt . | |
| 4,534,558 | 8/1985 | Yoneyama . | |
| 4,749,197 | 6/1988 | Orlowski . | |
| 4,754,969 | 7/1988 | Kobayashi | 273/78 X |
| 4,768,787 | 9/1988 | Shira . | |
| 4,792,140 | 12/1988 | Yamaguchi et al. | 273/78 X |
| 4,804,188 | 2/1989 | McKee et al. | 273/173 X |
| 4,809,978 | 3/1989 | Yamaguchi et al. . | |
| 4,824,116 | 4/1989 | Nagamoto et al. . | |
| 5,024,437 | 6/1991 | Anderson | 273/173 X |

FOREIGN PATENT DOCUMENTS

| | | | |
|---|---|---|---|
| 211781 | 12/1957 | Australia | 273/173 |
| 692134 | 6/1940 | Fed. Rep. of Germany . | |
| 62-07474 | 9/1987 | Japan . | |
| 64-85679 | 3/1989 | Japan . | |
| 3822 | of 1893 | United Kingdom . | |
| 2248 | of 1894 | United Kingdom . | |
| 15376 | of 1903 | United Kingdom . | |
| 15260 | of 1905 | United Kingdom . | |
| 243435 | 11/1925 | United Kingdom . | |
| 267755 | 3/1927 | United Kingdom . | |
| 379032 | 8/1932 | United Kingdom | 273/78 |
| 442557 | 2/1936 | United Kingdom | 273/80 R |
| 1227948 | 4/1971 | United Kingdom . | |
| 2146249 | 4/1985 | United Kingdom . | |

OTHER PUBLICATIONS

"Golf Digest", Magazine, Jan. 1975 issue, pp. 40-41.

*Primary Examiner*—Vincent Millin
*Assistant Examiner*—Sebastiano Passaniti
*Attorney, Agent, or Firm*—William W. Haefliger

[57] ABSTRACT

A golf club head has a main body portion formed by an investment casting of material such as stainless steel, beryllium copper, titanium, and aluminum. The face plate of the head is formed of a forged metal, such as forged carbon steel, this plate being welded to the face portion of the casting to form an integral assembly therewith. The forged metal face plate affords a more solid impact and feel to the club which provides better control. Also, it has very high strength. Preferably, the head consists of cast stainless steel, and the face plate of forged stainless steel, both steels being of the same composition. Face plate metal is preferably re-distributed toward the toe and heel of the head.

16 Claims, 5 Drawing Sheets

FIG. 8.
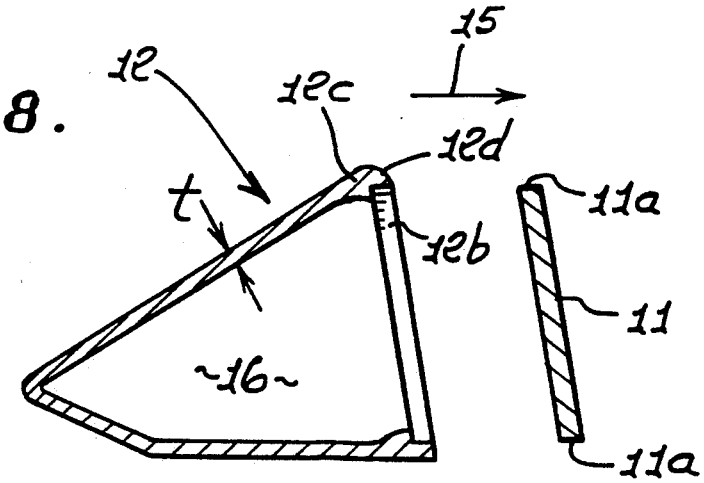
FIG. 9.
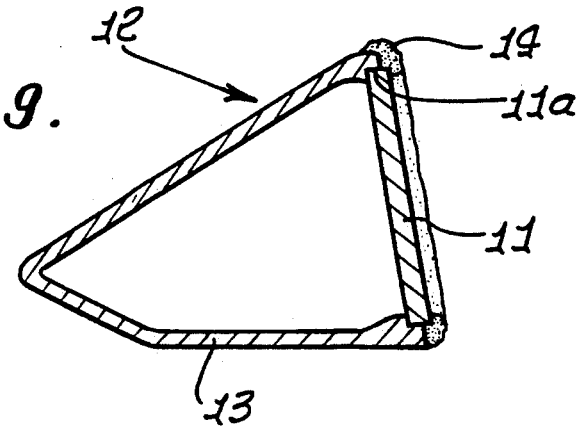
FIG. 10.
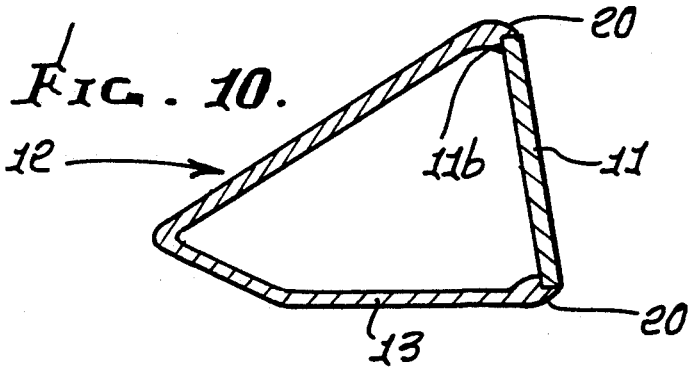
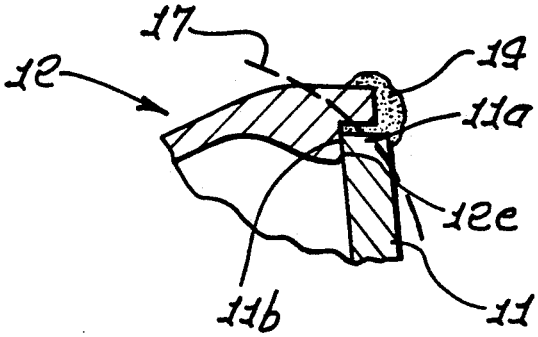
FIG. 11.

GOLF CLUB HEAD AND METHOD OF FORMING SAME

This application is a continuation-in-part of application Ser. No. 549,973, filed Jul. 9, 1990, now U.S. Pat. No. 5,094,38 which is a continuation-in-part of application, Ser. No. 492,973 filed Mar. 13, 1990, now U.S. Pat. No. 5,024,437 which is a continuation-in-part of Ser. No. 364,698 filed Jun. 12, 1989 now abandoned.

BACKGROUND OF THE INVENTION

This invention relates to golf clubs and more particularly to an improved face plate construction for a golf club head.

The heads of golf clubs are generally formed in a one-piece casting of durable materials, such as stainless steel, beryllium copper, aluminum, etc. A head of this type is described in U.S. Pat. No. 4,021,047 issued May 3, 1977, to R. J. Mader. The use of face plates made of a different material than that of the main body of the club head has been disclosed in the prior art in both irons and "wood"-type drivers, which are often made of cast metal. Such prior art club heads are described in U.S. Pat. No. 4,792,140 issued Dec. 20, 1988, to Yamaguchi et al.; U.S. Pat. No. 4,534,558 issued Aug. 13, 1985, to Yoneyama; U.S. Pat. No. 3,218,072 issued Nov. 16, 1965, to Burr; and British Patent No. 1.227.948 issued Apr. 15, 1971, to Haines et al. In the heads of all of these prior art patents, the face plate is of a plastic material, such as a resin or a carbon fiber composite. It has been found that the use of a forged metal for the face plate of the club head results in a stronger head and in a more solid impact with a golf ball and better "feel" which provides better ball flight control. However, forged metal is not amenable to casting, which mitigates against its use for forming the entire head. Also, forged metal tends to have a high density which would make for a club head having excessive weight.

SUMMARY OF THE INVENTION

The golf club head of the present invention provides an improvement over prior art heads in that it utilizes a face plate of forged metal. This end result is achieved without greatly increasing the cost or weight of the driving head by forming the main body of the head in an investment casting of a material such as stainless steel, beryllium copper, titanium, or aluminum, and then attaching a face plate of a forged metal selected from the class consisting of forged carbon steel, forged stainless steel, forged beryllium copper, and forged titanium, by suitable means such as welding.

It has been found that forged metal face plates have an inherently greater strength than cast metal face plates with a more uniform hardness over the hitting area of the plate. This is in view of the low porosity, high density and homogeneous grain structure of such a material which makes for a more solid plate. On the other hand, cast metal is desirable for the main body of the club head in view of its lighter weight, which tends to keep down the overall weight of the club head. It is essential that the face plate be solidly attached to the main body of the head by means such as welding to make for a solidly integrated head structure.

It is therefore an object of this invention to provide a golf club head having a face plate of a forged metal which gives more solid impact resistance and feel, to provide better control.

It is another object to provide a face plate that provides added heel and toe region weighting to a golf club, to enhance control of ball stroking; and it is an object to provide such a face plate that also consists of forged material.

These and other objects and advantages of the invention, as well as the details of an illustrative embodiment, will be more fully understood from the following specification and drawings, in which:

DRAWING DESCRIPTION

FIGS. 8–10 are sections taken in elevation to show plate and head attachment;

FIG. 11 is an enlarged section showing welding and finishing;

Figure 15:
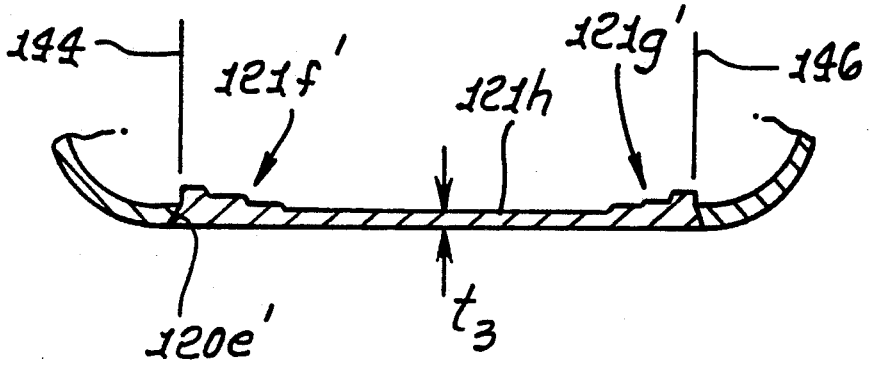
FIG. 15 is a view like FIG. 13 showing a modification.
Figure 15A:
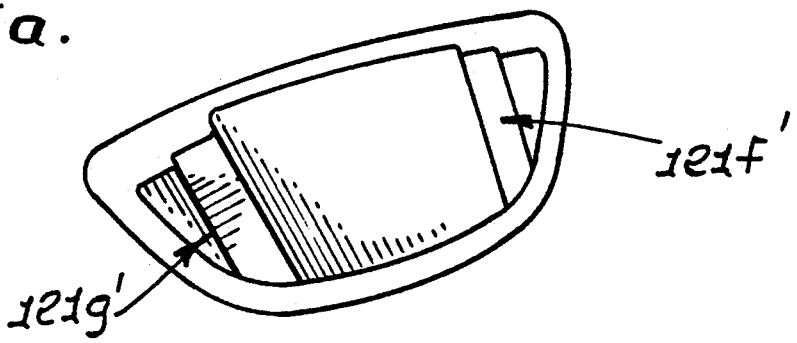

FIG. 15*a* is a perspective view of the FIG. 15 face plate; and

Figure 13:
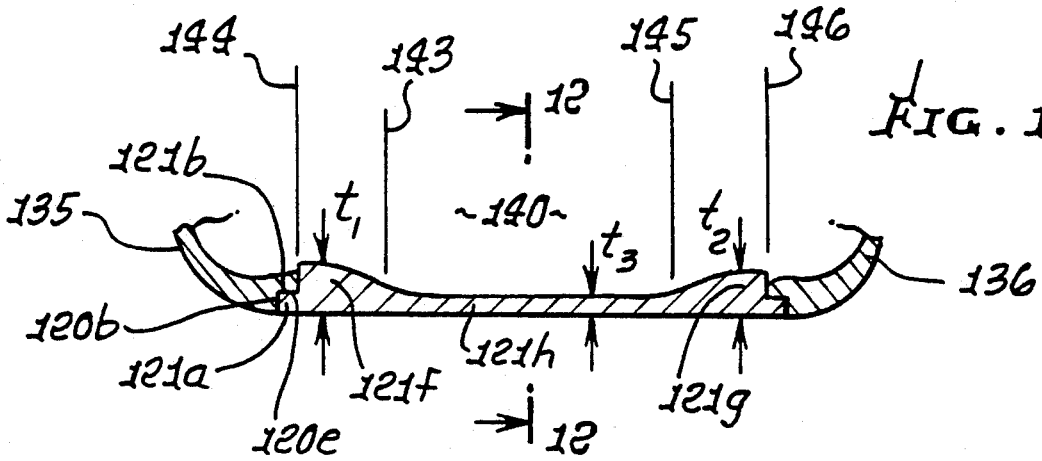
FIG. 13 is a section taken on lines 13—13 of FIG. 1.
Figure 16:
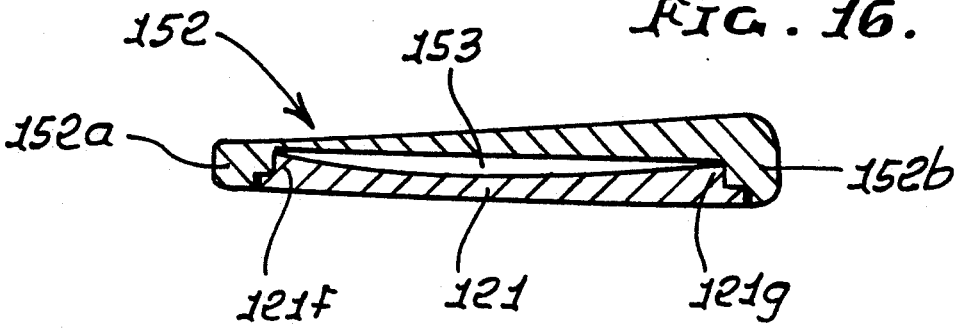

FIG. 16 is a view like FIG. 13, showing an iron incorporating the invention.

DETAILED DESCRIPTION

Referring to FIGS. 1–4, a first embodiment of the invention is illustrated. Face plate 11, which is fabricated of a material selected from the class consisting of forged carbon steel, forged stainless steel, forged beryllium copper, and forged titanium, has a lip portion 11*a* formed thereon. The main body 12 of the club head is formed by the investment casting of a material, such as stainless steel, beryllium copper, titanium, aluminum, etc. Main body portion 12 has a slot 12*a* formed therein and a recessed portion 12*b* which matingly receives face plate 11 with lip portion 11*a* fitting into slot 12*a*. Face plate 11 is solidly integrated with main body portion 12 by weld joints 14 formed along the perimeter of the face plate. In this manner, the face plate is solidly integrated with the casting.

Figure 1:
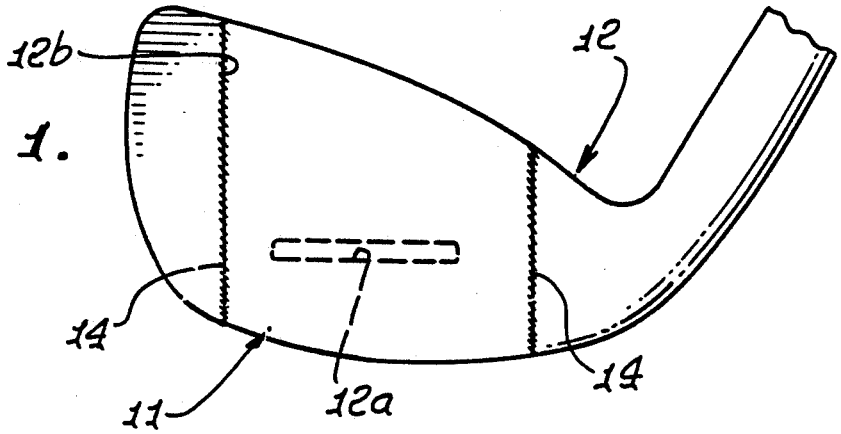
FIG. 1 is a side elevational view of a first embodiment of the invention.
Figure 2:
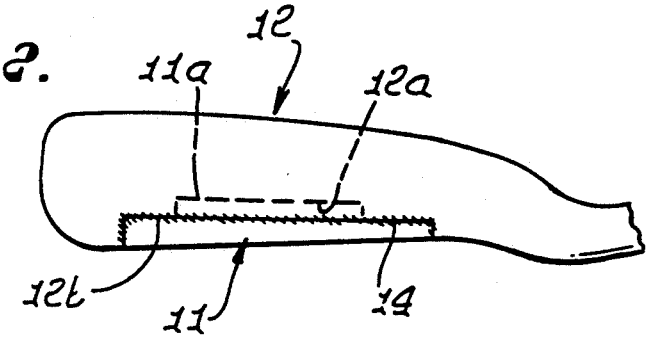
FIG. 2 is a bottom plan view of the first embodiment.
Figure 3:
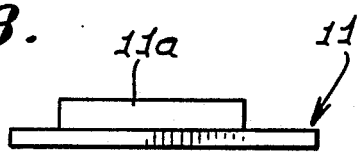
FIG. 3 is a top plan view illustrating the face plate employed in the first embodiment.
Figure 4:
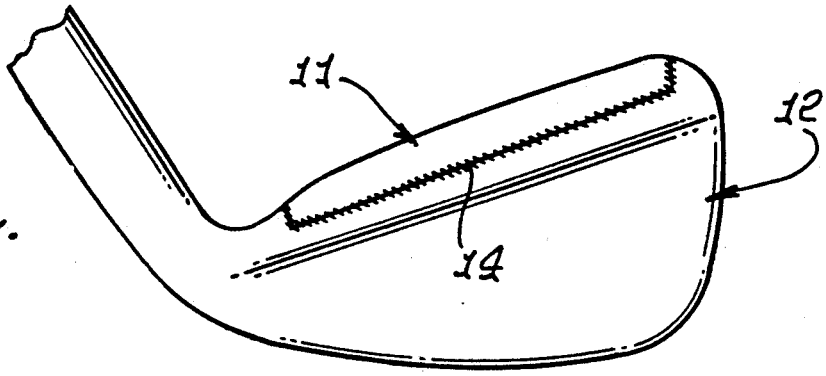
FIG. 4 is a top plan view of the first embodiment.
Figure 5:
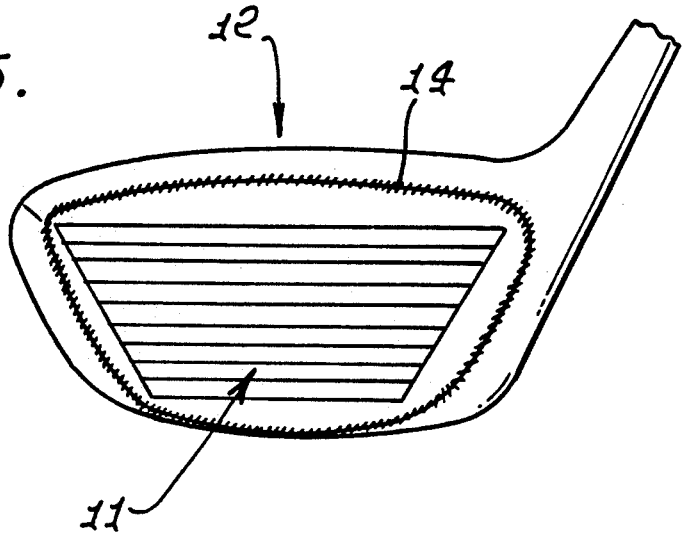
FIG. 5 is a side elevational view of a second embodiment of the invention.
Figure 6:
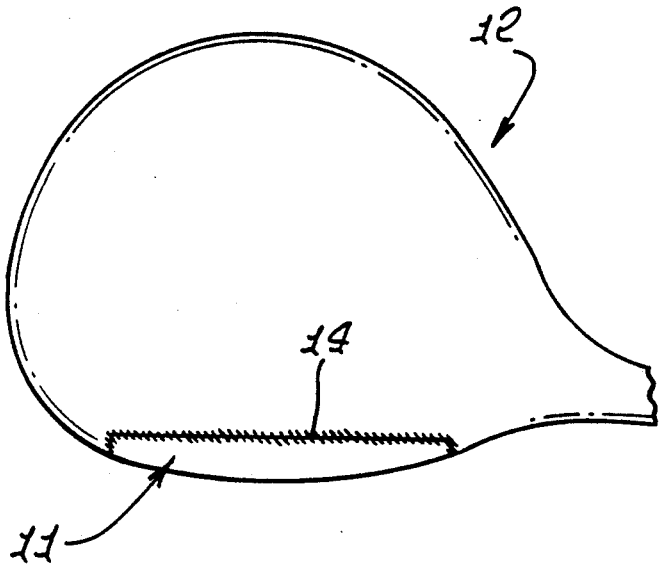
FIG. 6 is a bottom plan view of the second embodiment.
Figure 7:
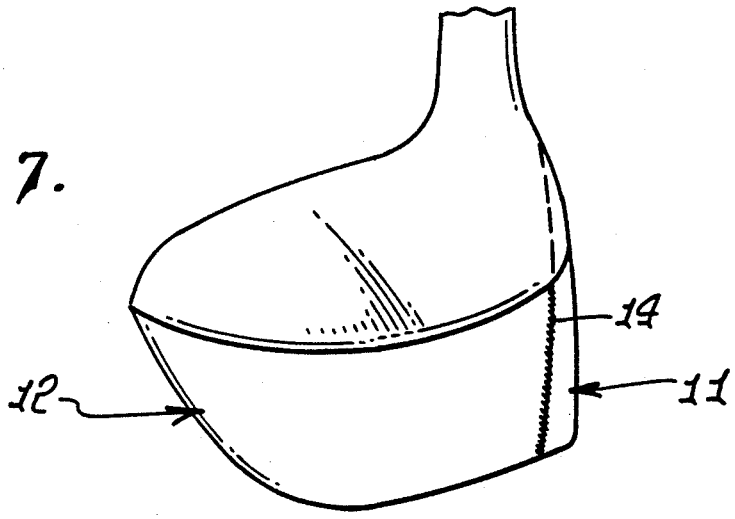
FIG. 7 is a front perspective view of the second embodiment.

Referring now to FIGS. 5–7, a second embodiment of the invention is illustrated, this embodiment being a "wood"-type driver. The main body portion 12, as for the previous embodiment, is formed by investment casting from a material such as stainless steel, beryllium copper, titanium, aluminum, etc. The face plate 11, as for the previous embodiment, is fabricated of forged metal selected from the same class of materials as for the first embodiment. The face plate 11 is abutted against the front surface of the casting and solidly joined thereto along weld joints 14, which run along the perimeter of the face plate thereby integrating the face plate with the casting.

For best results, both the head and the face plate consist of the same high strength material, i.e., stainless steel. One such steel is 17-4 PH forged stainless steel. This facilitates best weld connection of these parts and resistance to separation upon repeated sharp impacts with golf balls. See in this regard FIGS. 8-11, showing connection of these parts.

In FIG. 8, the peripheral slot 12*b* is shown formed in a thickened portion 12*c* of the cast stainless steel head which projects forwardly. See arrow 15. The slot and thickened portion 12*c* extend in a loop about the open end of the head, which is hollow at 16 Thickness "t" of the main wall extent of the head, rearward of 12*c*, is typically within the range 0.50 and 0.070 inches, except that the sole plate is typically between 0.085 and 0.100 inches. Head looping lip 12*d* overhangs the slot 12*b*, which is generally L-shaped in cross section. See FIG. 11.

FIG. 9 shows the forged stainless steel plate 11 looping periphery 11*a* closely fitted into the looping slot 12*b*; and FIG. 11 also shows this as well as the plate wall 11*b* abutting the looping ledge 12*e* which constitutes one wall of the slot.

FIG. 11 also shows weld material 14 applied to the elements 12*d* and 11*a*, and penetrating the clearance between 11*a* and 12*d*. After grinding, as along finish line 17, the looping peripheral edge of the head and plate is forwardly convexly rounded, as at 20 in FIG. 10, some weld material remaining, as in the clearance. A high strength, rigid connection is thereby effected between the high strength, compatible stainless steel elements 11 and 12, with element 11 being forged for extremely high strength and resistance to failure as by crack formation, and resistance to deformation, in use.

Forged plate 11 is preferably of uniform thickness, within the range 0.090 and 0.130 inches, and thicker than sole plate 13.

The method of forming the high strength head includes the steps:

a) casting a golf club head main body consisting of metal, b) forging a golf club head face plate consisting of metal, c) weld connecting the forged face plate to the front of the head main body to conform to the front periphery of the body.

Further, the a) step typically includes forming a lip 12*d* at the periphery of the head main body, and the c) step includes weld connecting the periphery 11*a* of the forged face plate to the lip 12*d*; and including grinding the weld, the lip and the plate periphery to form a forwardly convex and smooth head surface bounding the periphery of the plate.

Figure 12:
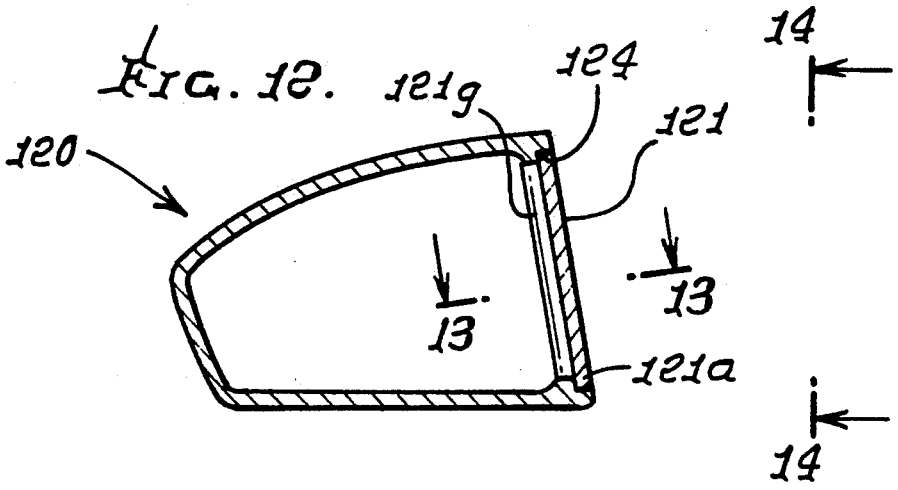
FIG. 12 is a vertical section taken through a metal wood head, showing another embodiment of the invention.
Figure 14:
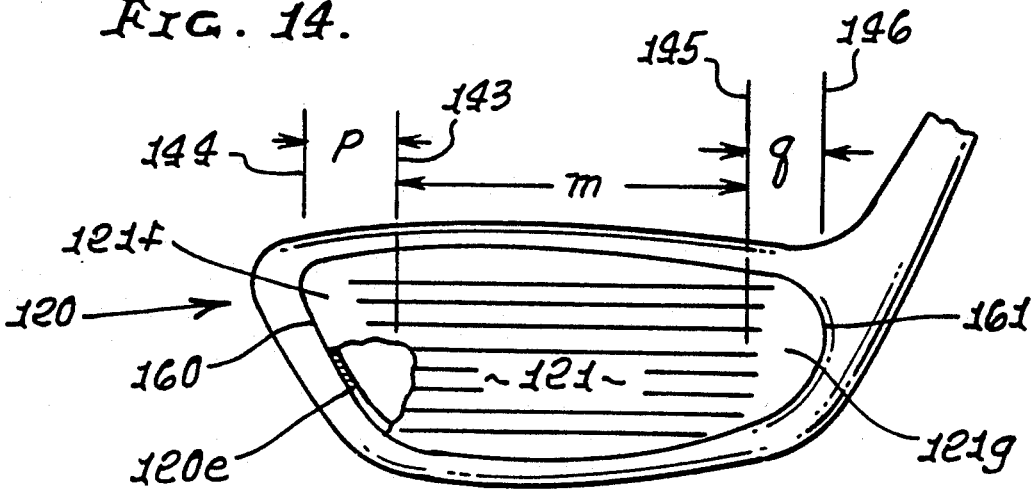
FIG. 14 is a front face view of the metal wood of FIG. 12, partly broken away.

Referring now to FIGS. 12-14, another embodiment of the invention is illustrated, i.e. a metal wood head having a main body portion 120 of a first metallic material. It may be formed of investment casting material such as stainless steel, beryllium copper, titanium, aluminum, etc. The face plate 121 is formed from a second metallic material, and is forged for high strength. Preferably, the face plate metal is the same as the main body metal, both typically consisting of stainless steel. The forged face plate 121 is peripherally abutted against a front ledge surface of the body (typically a casting), and solidly joined to the latter along weld joint 124, running along the looping peripheral portion of the face plate, integrating the face plate and body portion.

Thus, for example, the forged plate 121 has a looping periphery 121*a* fitting closely into the looping slot 120*b*, plate wall 121*b* abutting the looping ledge 120*e* which constitutes one wall of the slot. The fabrication including welding may be carried out as in FIG. 11, and its description, and a high strength failure resistant club head (metal wood) is thereby formed. The face plate 121 may have the looping peripheral shape of plate 11, and be upwardly convex; downwardly convex, and generally trapezoidal.

A feature of the invention is the provision of a face plate having first and second portions and an intermediate portion, the first and second portions of the face plate respectively located closer to said body toe and heel than the intermediate portion. In this regard, the plate first and second portions preferably have greater thickness than the intermediate portion. See first and second plate portions 121*f* and 121*g*, the former closest to the head toe 135; and the latter 121*g* closest to the head heel 136. FIG. 13 shows that the portions 121*f* and 121*g* both project toward the space 140 rearward of the plate; and FIG. 14 shows that portion 121*f* is located between front to rear planes 143 and 144, and portion 121*g* is located between front to rear planes 145 and 146. Plate intermediate portion 121*h* lies between planes 143 and 145 for example, and the lateral extent "m" of the intermediate portion 121*h* may be greater than each of the lateral extents "p" and "q" of the first and second plate portions 121*f* and 121*g*. Also, the intermediate portion 121*h* is centrally thinner than each of the portions 121*f* and 121*g*, whereby metal weight of the forged plate is "redistributed" toward the toe and heel of the face plate, and of the club head body, to resist twisting of the club head, and shaft, during impact and striking of a golf ball. As shown, the thickness $t_1$, of plate portion 121*f* progressively and smoothly increases toward plane 144; and the thickness $t_2$ of plate portion 121*g* progressively and smoothly increases toward plane 146. Welding 160 at the face plate toe, and 161 at the face plate heel also adds to toe and heel weighting effect.

FIG. 15 shows the same construction, except that the thickness of portion 121*f* increases as an upward stairstep 121*f'* toward plane 144; and the thickness of portion 121*g* increases as a stairstep 121*g'* toward plane 146. Intermediate portion 121*h* of the plate may have minimum thickness $t_3$ generally about midway between the increased thickness portions 121*f* and 121*g*; and $t_3$ may be between about 1 to 6 millimeters whereas $t_1$ and $t_2$ may each increase to about 4 to 8 millimeters, laterally. Other dimensions may be used. Looping ledge 120*e'* is slanted or tapered, as in a countersink, in FIG. 15. Other fastening methods (plate to head shell) may be employed.

In FIG. 16, a forged face plate 121 may be like that of FIG. 13, and be peripherally attached as by welding at 150 to a looping ledge 151 formed by iron head 152. Note plate weight "redistribution" at 121*f* and 121*g* toward the toe and heel 152*a* and 152*b* of the iron head, adding to "anti-twist" effect. Note recess 153 formed by the head body, and into which the thicker plate portions 121*f* and 121*g* project.

We claim:

1. A golf club head comprising:

a) a main body portion formed by an investment casting of a first metallic material, b) a face plate formed of a second material which is forged and is substantially softer than said first material, and c) means joining the periphery of said face plate to said main body portion to form a high strength, forged face plate for said golf club head, d) only the face plate being forged, e) the face plate having up, down, left and right peripheries, at least one of said peripheries being arcuate and elongated, f) the forged face plate increasing in thickness toward the toe, the plate also having a stair-stepped thickness configuration toward the toe.

2. The golf club head of claim 1 wherein said second forged material is forged steel, and said first cast material is a material selected from the class consisting of steel, beryllium copper, and aluminum.

3. The club head of claim 1 wherein said main body portion has a peripheral lip portion thereon, said main body portion having a forward facing slot formed therein, said main body portion further having a recessed portion into which the periphery of the face plate is fitted with said lip portion matingly facing said slot, said means joining said face plate to said main body portion comprising weld joint structure formed along the periphery of said face plate and welding said face plate periphery to said lip portion.

4. A golf club head comprising:

a) a main body portion formed by an investment casting of a first metallic material, b) a face plate formed of a second material which is forged and is substantially softer than said first material, and c) means joining the periphery of said face plate to said main body portion to form a high strength, forged face plate for said golf club head, the main body portion and the face plate both consisting of stainless steel of the same composition, d) the face plate having up, down, left and right peripheries, at least one of said peripheries being arcuate and elongated, e) only the face plate being forged, f) the forged face plate increasing in thickness toward the toe and toward the heel, the increase in thickness toward the toe having a stair-stepped configuration, and the increase in thickness toward the heel having a stair-stepped configuration.

5. The club head of claim 4 wherein the head is a golf wood.

6. A golf club head, comprising a) a main body portion formed of a first metallic material and having a toe and heel, b) a face plate formed of a second material which is formed of a second metallic material, c) means joining the periphery of said face plate to said main body portion to form a high strength plate for said head, d) said plate having first and second portions and an intermediate portion, said first and second portions respectively located closer to said body portion toe and heel than said intermediate portion, e) at least one of said plate first and second portions having greater thickness than said intermediate portion, f) the face plate being a forged element and the main body portion being a second element, only the face plate element being forged, g) the plate first and second portions respectively increasing in thickness toward the toe and toward the heel, each said increase in thickness also having a stair-stepped configuration.

7. The club head of claim 6 wherein said plate first portion located closer to said body portion toe progressively increases in thickness in a direction toward said toe.

8. The club head of claim 6 wherein said plate recessed portion located closer to said body portion heel progressively increases in thickness in a direction toward said heel.

9. The club head of claim 6 wherein said plate is elongated.

10. The club head of claim 9 wherein the body consists of steel, and said plate material is selected from the group consisting of steel, beryllium copper and aluminum.

11. The club head of claim 9 wherein the body portion and plate both consist of the same material which is steel.

12. The club head of claim 6 wherein said face plate consists of stainless steel.

13. The club head of claim 6 wherein the main body portion is a metal wood shell.

14. The club head of claim 6 wherein the main body portion is an iron defining a recess into which the plate projects.

15. A golf club head having, in combination a) a main head body which has first toe and heel portions, b) a face plate joined to said body, and consisting of forged metal, the face plate having second toe and heel portions, and at opposite sides of an intermediate portion of the face plate, said face plate second toe portion located closer to said body first toe portion than said intermediate portion, and said face plate second heel portion located closer to said body first heel portion than said intermediate portion, c) said face plate second toe and heel portions having greater thickness than said face plate intermediate portion to cause the head to resist twisting when said face plate intermediate portion strikes a golf ball.

d) said face plate toe and heel portions also each having a stair-stepped configuration, e) said face plate being forged and being the only forged component of the head.

16. A golf club head, comprising a) a main body portion formed of a first metallic material and having a toe and heel;

b) a face plate formed of a second material which is formed of a second metallic material, c) means joining the periphery of said face plate to said main body portion to form a high strength plate for said head, d) said plate having first and second portions and an intermediate portion, said first and second portions respectively located closer to said body portion toe and heel than said intermediate portion, e) at least one of said plate first and second portions having greater thickness than said intermediate portions, f) said face plate being forged, and being the only element which is forged, and said main body portion metallic material and said face plate metallic material both having substantially the same composition, g) the plate first and second portions respectively increasing in thickness toward the toe and toward the heel, each said increase in thickness also having a stair-stepped configuration.

* * * * *

UNITED STATES PATENT AND TRADEMARK OFFICE

CERTIFICATE OF CORRECTION

PATENT NO. : 5,261,663

DATED : November 16, 1993

INVENTOR(S) : Donald A. Anderson

It is certified that error appears in the above-identified patent and that said Letters Patent is hereby corrected as shown below:

On the title page, [75] Inventor: should read:

--Donald A. Anderson, Huntington Beach, and Donald J. C. Sun, San Diego, both of California--

Signed and Sealed this

Eleventh Day of April, 1995

Bruce Lehman

*Attest:*

BRUCE LEHMAN

*Attesting Officer*

*Commissioner of Patents and Trademarks*